US011394132B2

(12) United States Patent
Ohfuku et al.

(10) Patent No.: US 11,394,132 B2
(45) Date of Patent: Jul. 19, 2022

(54) CABLE ASSEMBLY

(71) Applicant: Yazaki Corporation, Tokyo (JP)

(72) Inventors: Ryosuke Ohfuku, Shizuoka (JP); Kouji Miyawaki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/347,743

(22) Filed: Jun. 15, 2021

(65) Prior Publication Data

US 2021/0399441 A1 Dec. 23, 2021

(30) Foreign Application Priority Data

Jun. 19, 2020 (JP) ..... JP2020-105749

(51) Int. Cl.

| | |
|---|---|
| ***H01R 13/58*** | (2006.01) |
| ***H01R 4/18*** | (2006.01) |
| ***H01R 13/6583*** | (2011.01) |
| ***H01R 13/6474*** | (2011.01) |
| ***H01R 13/6463*** | (2011.01) |

(52) U.S. Cl.

CPC ..... *H01R 4/183* (2013.01); *H01R 13/6463* (2013.01); *H01R 13/6474* (2013.01); *H01R 13/6583* (2013.01)

(58) Field of Classification Search

CPC ..... H01R 12/79; H01R 2/78; H01R 12/592; H01R 9/0757; H01R 13/193; H01R 23/7068; H01R 43/24

See application file for complete search history.

(56) References Cited

U.S. PATENT DOCUMENTS

| | | | | |
|---|---|---|---|---|
| 2013/0280963 | A1* | 10/2013 | Shih | H01R 24/58 439/669 |
| 2013/0299229 | A1* | 11/2013 | Kato | H01R 13/5208 174/377 |
| 2013/0319761 | A1* | 12/2013 | Furukawa | H01R 9/0518 29/828 |
| 2014/0097015 | A1* | 4/2014 | Suzuki | H01R 13/65912 174/359 |
| 2017/0069983 | A1* | 3/2017 | Ohfuku | H01R 13/4361 |
| 2019/0067875 | A1* | 2/2019 | Ohfuku | H01R 13/641 |
| 2019/0312388 | A1 | 10/2019 | Maesoba et al. | |
| 2019/0356101 | A1* | 11/2019 | Masuda | H01R 4/20 |
| 2020/0205877 | A1* | 7/2020 | Friedrichs | A61B 18/14 |

FOREIGN PATENT DOCUMENTS

JP 2018-063795 A 4/2018

* cited by examiner

*Primary Examiner* — Phuong Chi Thi Nguyen
(74) *Attorney, Agent, or Firm* — Sughrue Mion, PLLC

(57) ABSTRACT

The sleeve is crimped to the outer periphery of the braid, the braid is folded back by the folding-back portion at the front end side of the sleeve, the folded-back braid covers the outer periphery of the sleeve, the braided crimping piece of the shield terminal is crimped to the outer periphery of the sleeve via the folded-back braid, the folded-back braid is held between the sleeve and the braid crimping piece, the sheath crimping piece is crimped to the outer periphery of the sheath, and when a tensile force is applied in the direction in which the cable is relatively separated from the shield terminal, the sleeve is moved in the tensile direction, so that the rear end edge of the sleeve and the front end edge of the sheath crimping piece are brought into abutment with each other.

5 Claims, 6 Drawing Sheets

CABLE ASSEMBLY

CROSS REFERENCE TO RELATED APPLICATION

This application is based upon and claims the benefit of priority under 35 U.S.C. § 119 from Japanese Patent Application No. 2020-105749 filed on Jun. 19, 2020, the entire contents of which are incorporated herein by reference.

TECHNICAL FIELD

The present application relates to a cable assembly of a shield connector such as a high-speed transmission connector.

BACKGROUND

Japanese Patent Application Publication No. 2018-63795 discloses a shielded twisted pair (STP) connector as a shield connector provided with a shielded twisted pair cable.

SUMMARY

However, in the case of the STP connector disclosed in Japanese Patent Application Publication No. 2018-63795, when a tensile force is applied in a direction in which the STP cable is relatively separated from the outer conductor, there is a possibility that a shield conductor such as a braided wire is misaligned from a barrel portion, and in the worst case, the shield conductor may fall out from the barrel portion. Therefore, there is a concern that the electrical connection reliability between the outer conductor and the shield conductor such as a braided wire in the STP cable may be reduced due to misalignment.

An object of the present application is to provide a cable assembly with high electrical connection reliability capable of preventing a cable from relatively separating from a shield terminal even when a tensile force is applied in a direction in which the cable is relatively separated from the shield terminal.

According an embodiment of the present application, a cable assembly comprises a shield terminal including a braided crimping piece and a sheath crimping piece, a cable including a braid and a sheath, and a sleeve attached to an outer periphery of the braid. In the cable assembly, the sleeve is disposed on the outer periphery of the braid by crimping, the braid is folded back at a front end side of the sleeve by a folding-back portion, the braid folded back by the folding-back portion covers an outer periphery of the sleeve, the braided crimping piece of the shield terminal is crimped to the outer periphery of the sleeve via the braid folded back by the folding-back portion, and the braid folded back by the folding-back portion is held between the sleeve and the braided crimping piece, a sheath crimping piece of the shield terminal is crimped to an outer periphery of the sheath of the cable, and when a tensile force is applied in a direction in which the cable is relatively separated from the shield terminal, the sleeve is moved in a tensile direction, so that a rear end edge of the sleeve and a front end edge of the sheath crimping piece are brought into abutment with each other.

It is preferable that the sheath crimping piece is crimped to the outer periphery of the sheath such that an inner diameter of the braid in a crimped portion of the sheath crimping piece is the same or substantially the same as an inner diameter of the braid in an uncrimped portion of the sheath.

It is preferable that the sleeve is formed in a C-shaped plate, and the C-shaped sleeve is cylindrically crimped to the outer periphery of the braid.

It is preferable that the sleeve includes an engagement recess at one end side and an engagement protrusion at the other end side, and the engagement protrusion is fitted into the engagement recess when the sleeve is crimped to the outer periphery of the braid.

It is preferable that the cable assembly further comprises an inner housing to which a terminal connected to an exposed internal wire is attached to an end of the cable and a matching member for impedance adjustment having an insertion hole into which the internal wire is inserted, and the inner housing and the matching member are integrally housed in a shield connecting portion of the shield terminal.

According to the above configuration, it is possible to provide a cable assembly with high electrical connection reliability capable of preventing a cable from relatively separating from a shield terminal even when a tensile force is applied in a direction in which the cable is relatively separated from the shield terminal.

DETAILED DESCRIPTION

A cable assembly according to an embodiment of the present application will be described in detail below with reference to the drawings.

Figure 1:
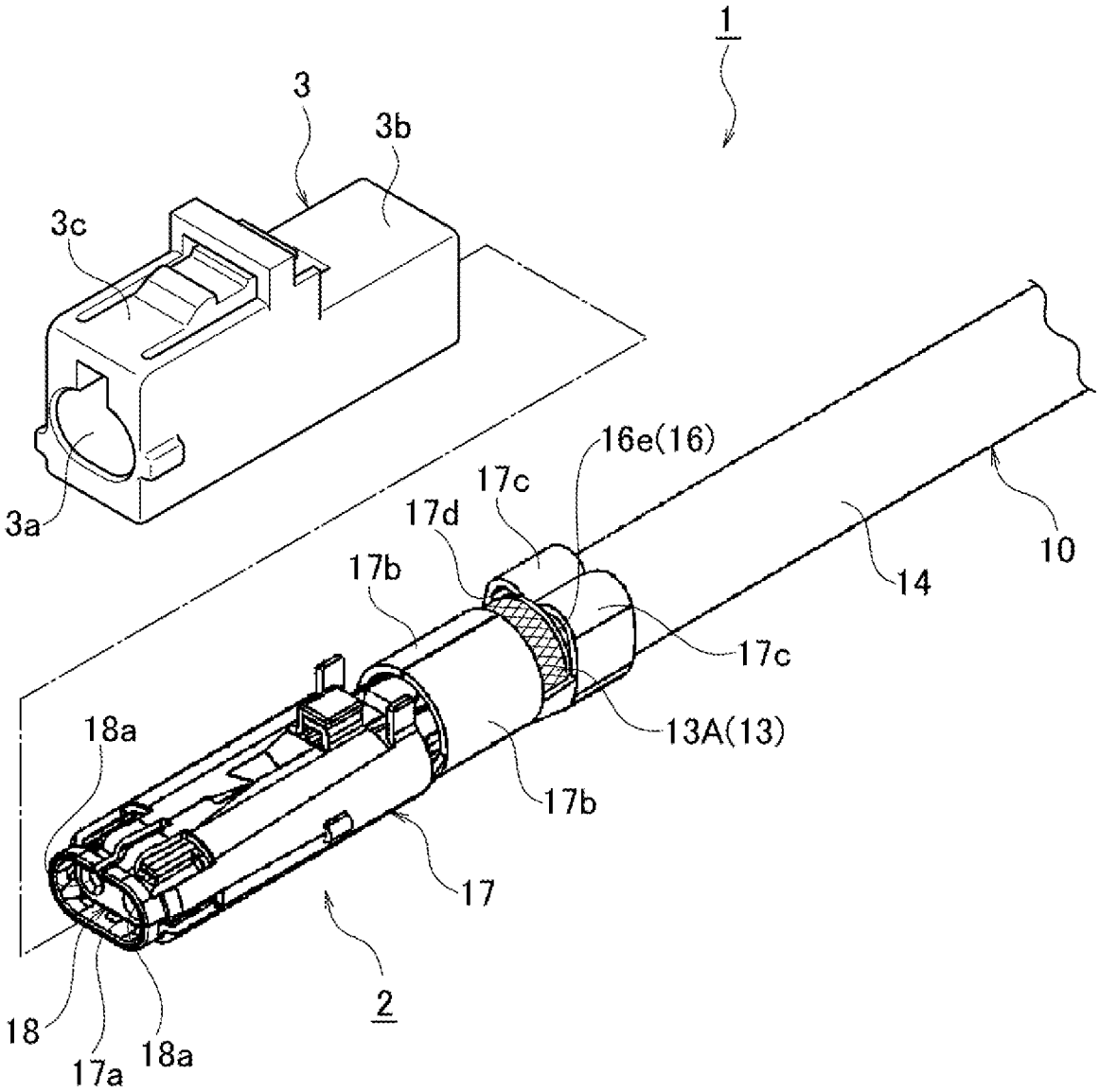
FIG. 1 is a perspective view showing an example of a shield connector using a cable assembly according to an embodiment of the present application.

As shown in FIG. 1, a shield connector 1 includes a cable assembly 2 for high-speed transmission and connected to an end of a shielded twisted pair (STP) electric wire which is a cable 10, and an outer housing 3 for housing the cable assembly 2. That is, the shield connector 1 is a high-speed transmission connector for differential communication and has an electromagnetic shield structure.

As shown in FIG. 1, an outer housing 3 is formed in a box shape made of resin and includes an assembly housing portion 3*a* for housing the cable assembly 2. A lock arm 3*c*, which maintains a fitting state when the outer housing 3 is fitted to a mating connector (not shown), is provided on an upper surface 3*b* side of the outer housing 3.

Figure 2:
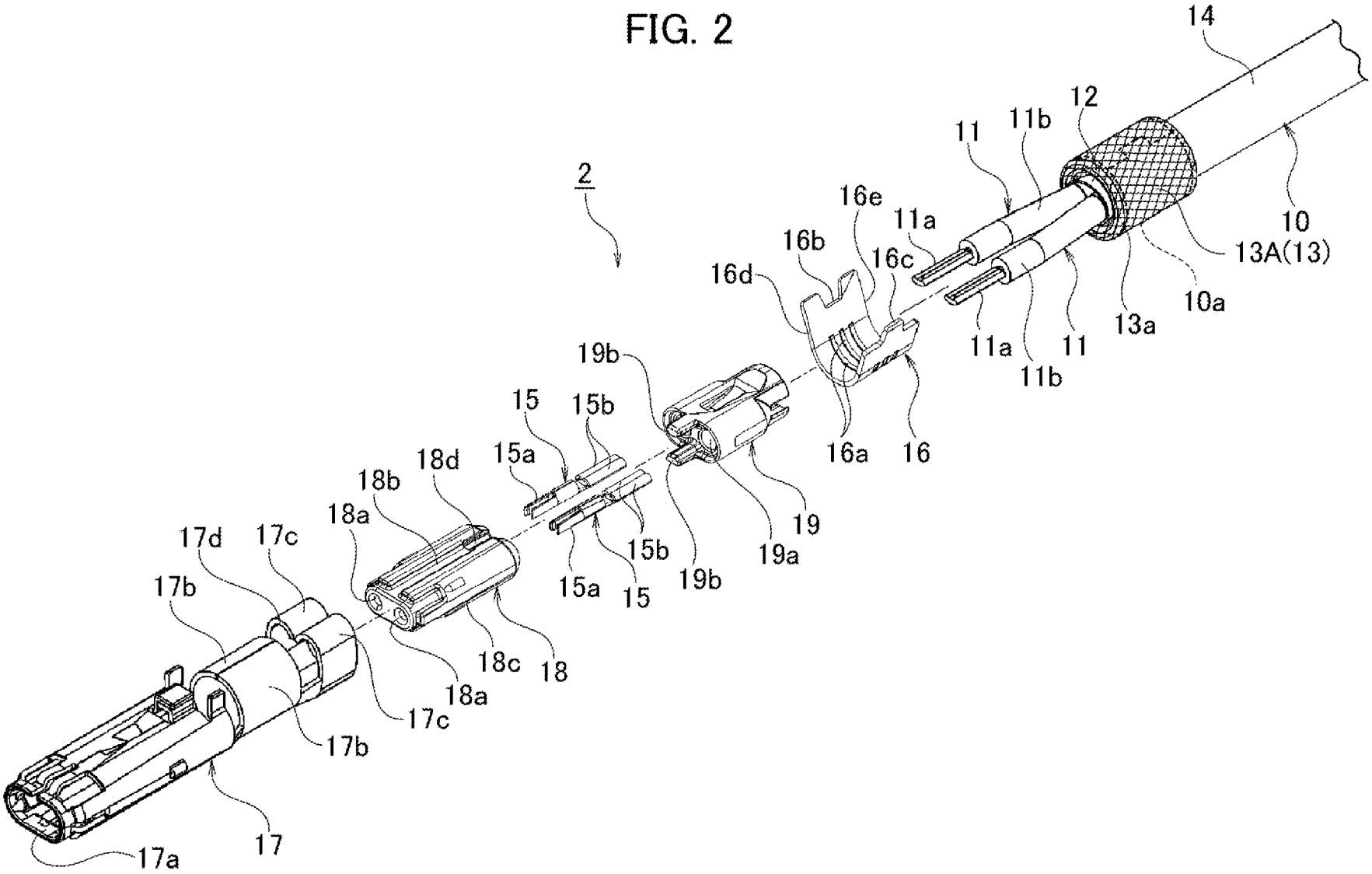
FIG. 2 is an exploded perspective view of the cable assembly.

As shown in FIGS. 1 and 2, the cable assembly 2 includes a cable 10, a metal female terminal (terminal) 15, a sleeve 16, a shield terminal 17, an inner housing 18, and a matching member for impedance adjustment 19 as component elements.

Figure 4:
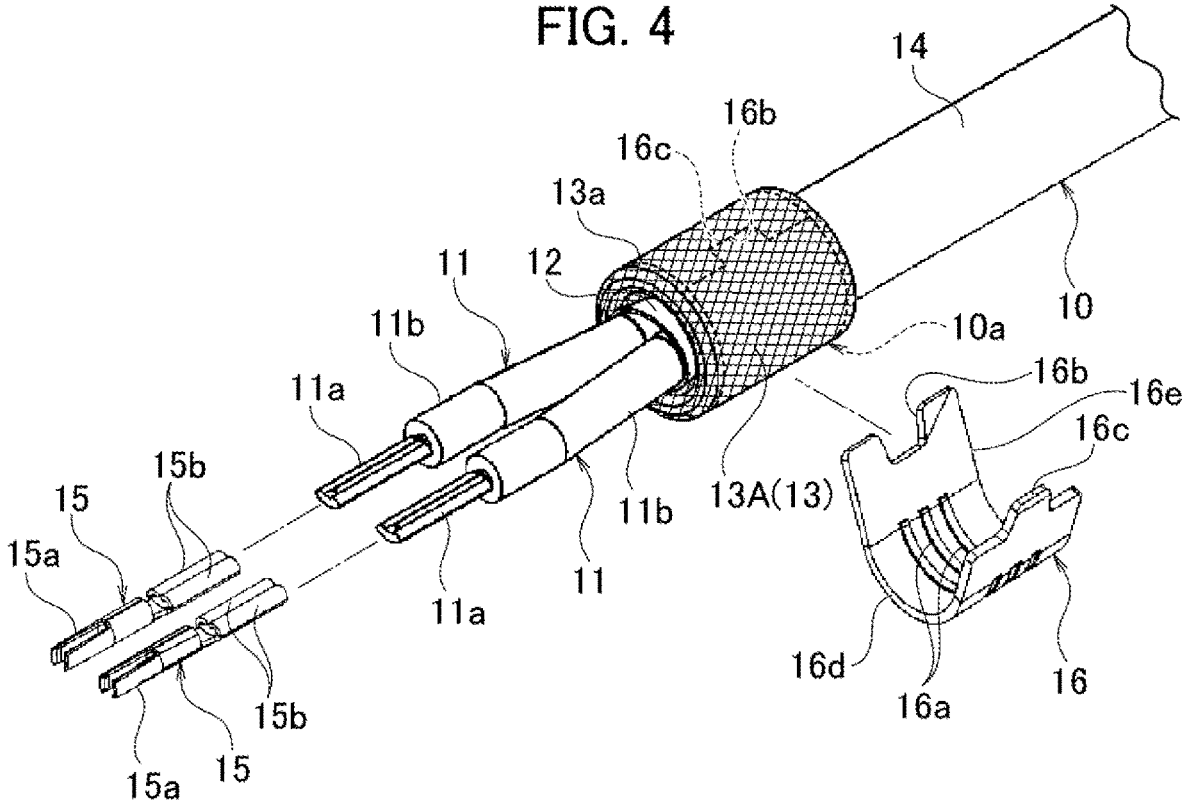
FIG. 4 is a perspective view showing a state before assembling a terminal to an end of a cable of the cable assembly.
Figure 5:
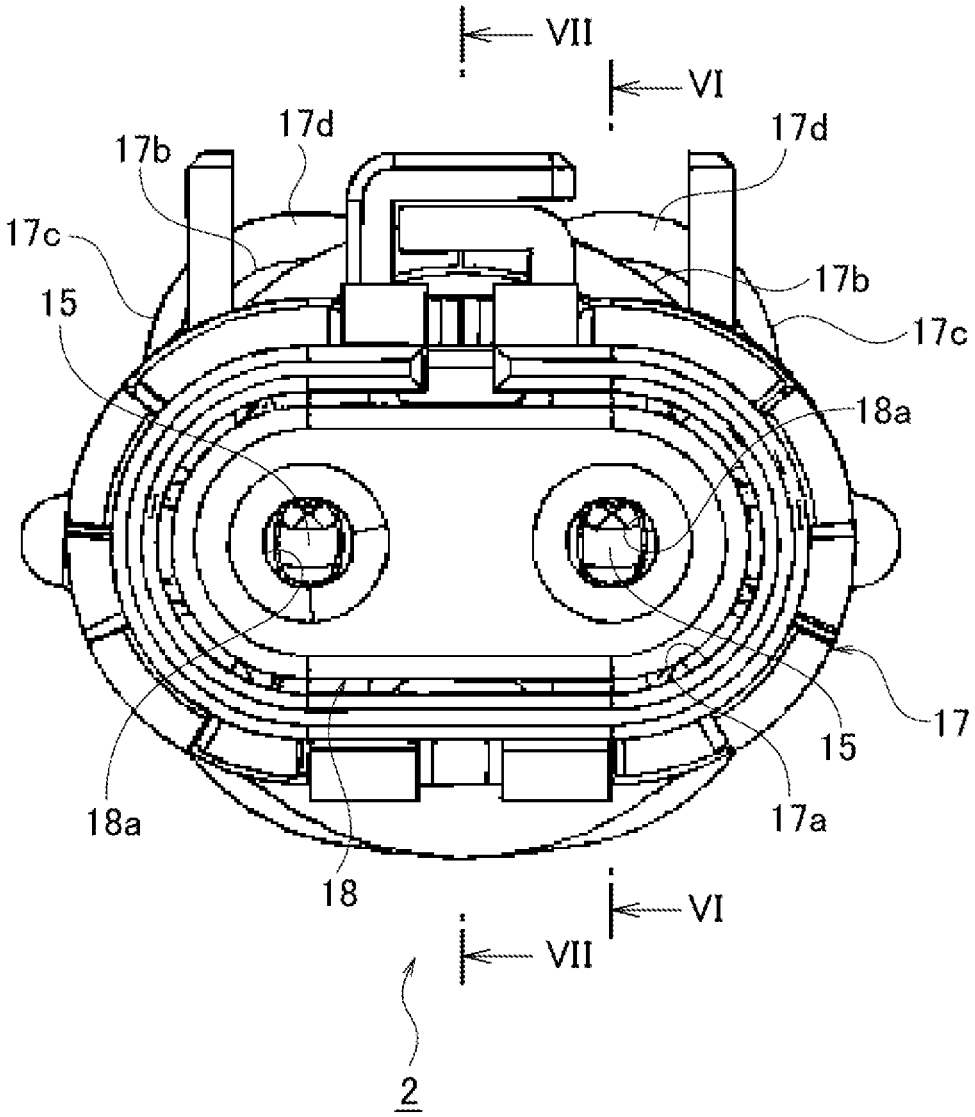
FIG. 5 is a front view of the cable assembly.
Figure 7:
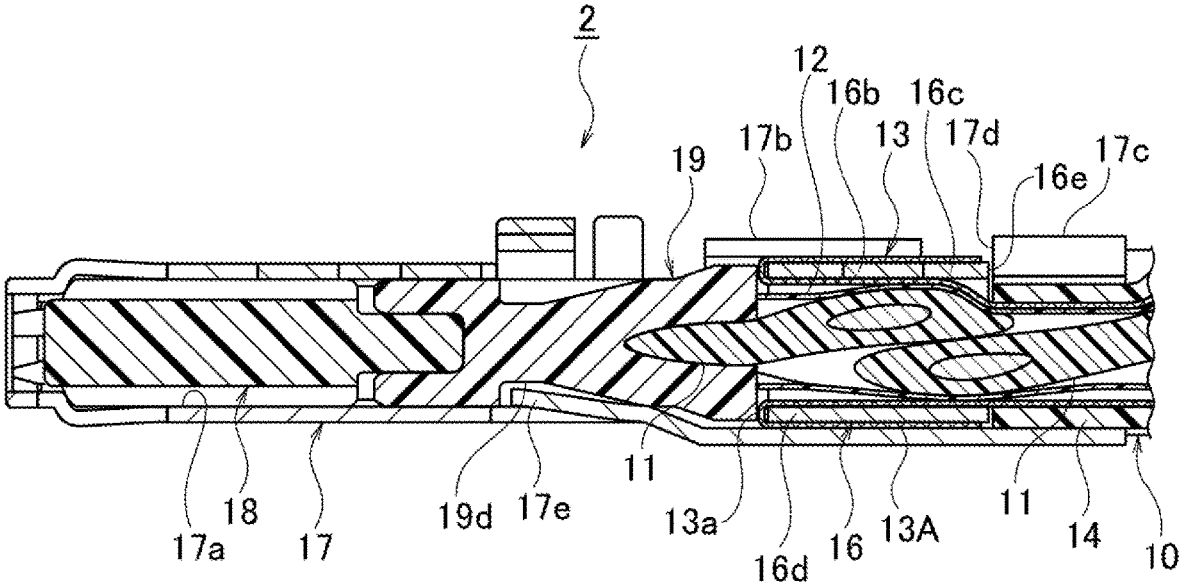
FIG. 7 is a cross-sectional view taken along line VII-VII in FIG. 5.

As shown in FIGS. 2, 4, and 7, the cable 10 includes two twisted internal wires 11, a metal braid 13 covering the two internal wires 11 via a shield foil 12, and a sheath 14, which is a resin outer coating, for covering the braid 13. Each internal wire 11 includes a metal core wire 11*a* and a resin insulating film 11*b* covering the core wire 11*a*. The two internal wires 11 exposed on the end 10*a* side of the cable 10 are untwisted, and a pair of core wire crimping pieces 15*b* of a female terminal 15 are crimp-connected to the core wire 11*a* exposed from the respective insulating films 11*b*. The female terminal 15 includes a contact portion 15*a* to which a tab of a male terminal of a mating connector (not shown) is electrically connected to the front side of the pair of core wire crimping pieces 15*b*. In the female terminal 15 shown in FIGS. 2 and 4, the pair of core wire crimping pieces 15*b* are shown in a crimped shape.

Figure 6:
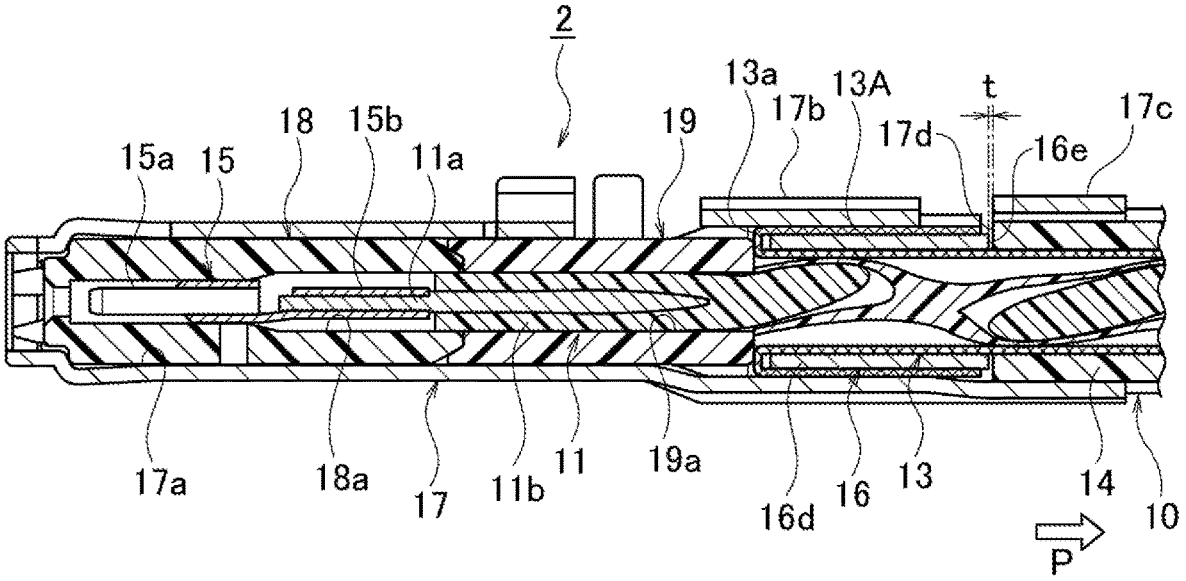
FIG. 6 is a cross-sectional view taken along line VI-VI in FIG. 5.
Figure 8:
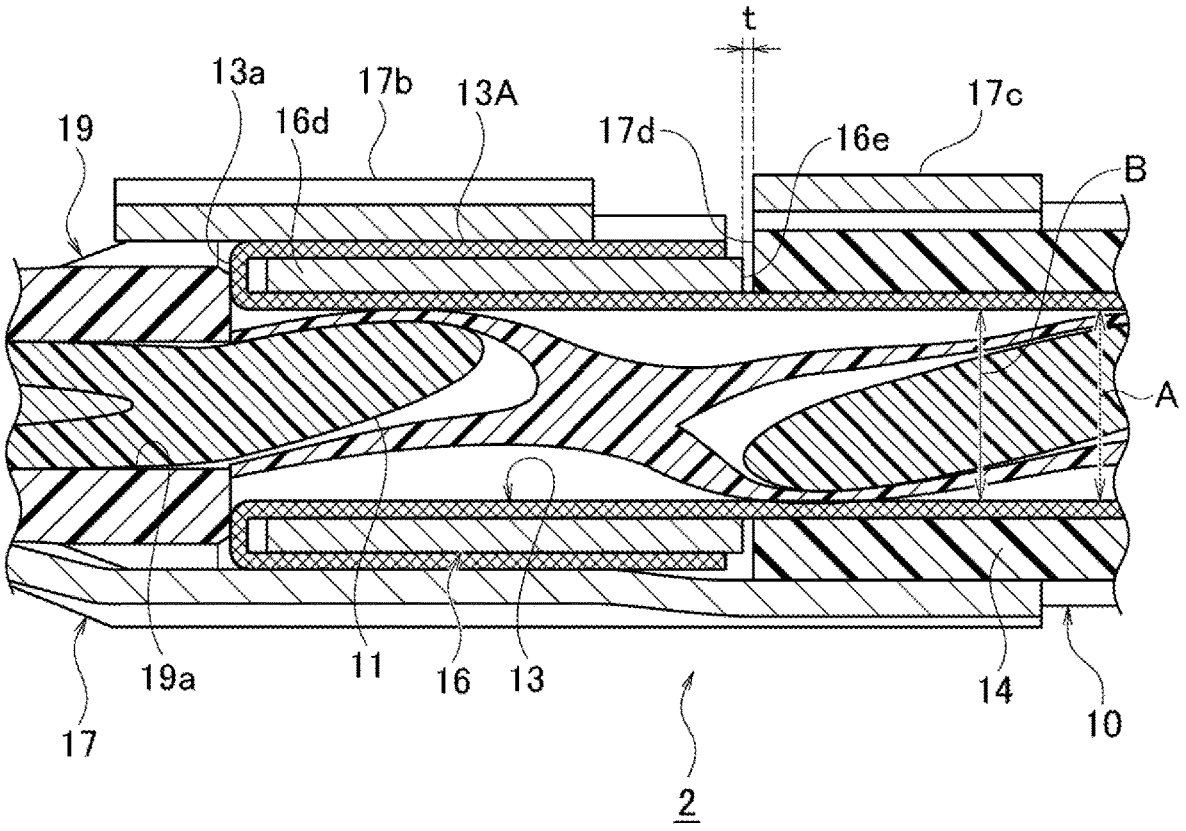
FIG. 8 is an enlarged cross-sectional view of a main portion of the cable assembly.

As shown in FIGS. 2 and 4, a sleeve 16 is made of metal and formed in a C-shaped plate before being crimped, and is attached to an outer periphery of the braid 13 where a part of a sheath 14 of the cable 10 is cut off and exposed. The C-shaped sleeve 16 includes a plurality of protrusions 16*a* at the center, an engagement recess 16*b* at one end, and an engagement protrusion 16*c* at the other end. As shown in FIGS. 6 and 8, when a braided crimping piece 17*b* of a shield terminal 17 to be described later is crimped to a folded-back braid 13A of the cable 10, the folded-back braid 13A is disposed at a position adjacent to a front end edge 17*d* of a sheath crimping piece 17*c* from the front side in the braided crimping piece 17*b*. That is, as shown in FIGS. 4 and 7, the C-shaped sleeve 16 is disposed on the outer periphery of the braid 13 by being crimped in a cylindrical shape, while being covered with the folded-back braid 13A with the engagement protrusion 16*c* fitted into the engagement recess 16*b*. That is, as shown in FIGS. 6 to 8, the braid 13 is folded back toward a rear end edge 16*e* side by a folding-back portion 13*a* at a front end 16*d* of the sleeve 16 which is crimped in a cylindrical shape, and the braid 13A folded back at the folding-back portion 13*a* covers an outer periphery of the cylindrical sleeve 16.

As shown in FIG. 2, the shield terminal 17 is formed by sheet metal working using a sheet metal material. The shield terminal 17 includes a cylindrical housing portion 17*a*, serving as a shield connecting portion, for housing an inner housing 18 and a matching member 19. The shield terminal 17 includes a pair of braided crimping pieces 17*b* for crimping and connecting the braid 13 exposed by cutting off a part of the sheath 14 of the cable 10, and a pair of sheath crimping pieces 17*c* for crimping and connecting the sheath 14 of the cable 10. As shown in FIG. 6, the braided crimping piece 17*b* of the shield terminal 17 crimps the sleeve 16 crimped to the outer periphery of the braid 13 exposed from the sheath 14, while crimping and connecting the braid 13A folded back by the folding-back portion 13*a* covering the outer periphery of the sleeve 16. That is, the braided crimping piece 17*b* is crimped to the outer periphery of the sleeve 16 via the braid 13A folded back by the folding-back portion 13*a*. The braid 13A folded back by the folding-back portion 13*a* is held by the sleeve 16 and the braid crimping piece 17 *b*, and the shield terminal 17 and the braid 13 are electrically connected.

When the crimping connection between the cable 10 and the shield terminal 17 is described in detail, as shown in FIGS. 6 to 8, the sheath crimping piece 17*c* of the shield terminal 17 is crimped to the outer periphery of the sheath 14 of the cable 10. The cable 10 is held (fixed) to the shield terminal 17 by crimping the braided crimping piece 17*b* to the sleeve 16 via the braid 13A folded back at the folding-back portion 13*a* and further crimping the sheath crimping piece 17*c* to the sheath 14. In this case, as shown in FIGS. 6 and 8, the rear end edge 16*e* of the sleeve 16 and the front end edge 17*d* of the sheath crimping piece 17*c* are adjacent to each other. That is, there is some clearance t in the axial direction between the rear end edge 16*e* of the sleeve 16 and the front end edge 17*d* of the sheath crimping piece 17*c*. In the shield terminal 17 shown in FIG. 2, the pair of braided crimping pieces 17*b* and the pair of sheath crimping pieces 17*c* are shown in a crimped shape.

Figure 3:
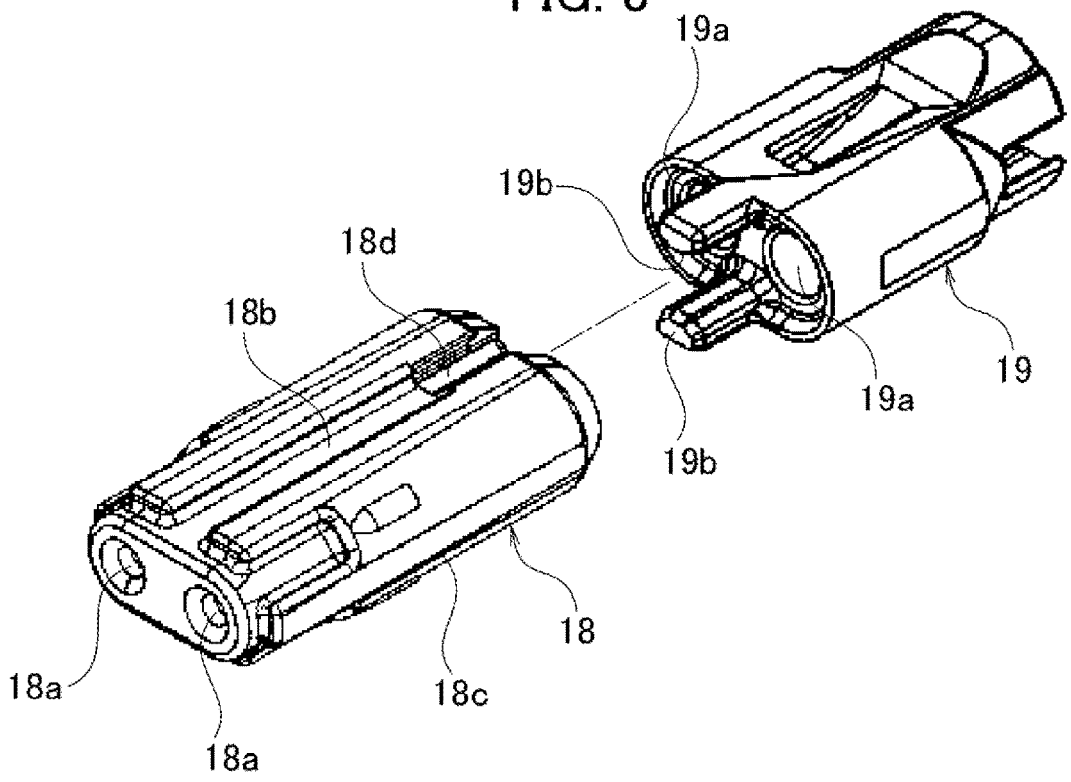
FIG. 3 is a perspective view showing a state before assembling an inner housing and a matching member of the cable assembly.

As shown in FIG. 2, FIG. 3, and FIG. 6, an inner housing 18 is formed of synthetic resin in an elliptical cylindrical shape, and includes a pair of right and left terminal housing chambers 18*a* on both sides of the inner housing 18. Each female terminal 15, which is connected to the end of the cable 10, is inserted into the pair of right and left terminal housing chambers 18*a*. The female terminal 15 housed in the respective terminal housing chambers 18*a* is held by locking means (not shown). In the center of the rear side of an upper surface 18*b* and a lower surface 18*c* of the inner housing 18, an engagement groove (engagement recess) 18*d* into which a pair of engagement protrusions 19*b* and 19*b* of the resin matching member 19, which will be described later, are press-fitted is formed.

As shown in FIGS. 6 and 7, the matching member 19 is a dielectric for impedance adjustment, and is interposed between the inner housing 18 and the sleeve 16 to suppress impedance mismatch and improve the transmission performance of the cable assembly 2 of the shield connector 1. As shown in FIGS. 2 and 3, the matching member 19 for impedance adjustment is formed in a resin cylindrical shape having a pair of insertion holes 19*a* into which untwisted portions of the internal wires 11 crimp-connected to the two female terminals 15 are inserted. Further, at the front of the center of the upper and lower portions, the matching member 19 is provided with an engagement protrusion (engagement portion) 19*b* which is press-fitted into the upper and lower engagement grooves 18*d* of the inner housing 19. The engagement groove 18*d* and the engagement protrusion 19*b* constitute engagement means for integrating the inner housing 18 and the matching member 19. As shown in FIG. 7, in the cylindrical housing portion 17*a* of the shield terminal 17, the integrated inner housing 18 and the matching member 19 are housed, and are held by locking means including a locking piece portion 17*e* and a locking recess portion 19*d*. Instead of the matching member 19 which is a dielectric, a metallic member which is a conductor may be used.

Next, the assembling procedure of each component constituting the cable assembly 2 described above will be described.

First, a part of the sheath 14 of the end 10*a* of the cable 10 is cut off to expose the braid 13, and the sleeve 16 is cylindrically crimped to the outer periphery of the exposed braid 13. As shown in FIG. 4, an end portion of the braid 13 is folded back toward the rear end edge 16*e* so that the braid 13A folded back at the folding-back portion 13*a* of the braid 13 covers the outer periphery of the cylindrical sleeve 16.

Next, the core wire crimping piece 15*b* of the female terminal 15 is crimp-connected to the core wire 11*a* exposed from each insulating film 11*b* of the two internal wires 11 exposed to the end 10*a* side of the cable 10. Thereafter, the two female terminals 15 and 15 are inserted into the pair of insertion holes 19*a* of the matching member 19 for impedance adjustment and housed in the pair of terminal housing chambers 18*a* of the inner housing 18.

Then, the engagement protrusion 19*b* of the matching member 19 is press-fitted and held in the engagement groove 18*d* of the inner housing 18, and the inner housing 18 integrated with the matching member 19 is housed in the housing portion 17*a* of the shield terminal 17. Thereafter, the braided crimping piece 17*b* of the shield terminal 17 is crimped to the braid 13A folded back at the folding-back portion 13*a* of the braid 13 of the cable 10, and the sheath crimping piece 17*c* is crimped to the sheath 14 of the cable 10 to complete the cable assembly 2 shown in FIGS. 1 and 6.

According to the cable assembly 2 of the above embodiment, as shown in FIG. 6, even if a tensile force is applied in the direction P in which the cable 10 is separated from the shield terminal 17, the cable 10 is prevented from being separated from the sheath crimping piece 17*c* of the shield terminal 17.

Specifically, as shown in FIG. 6, when the cable assembly 2 is conveyed or mounted on a vehicle as a shield connector 1 for a high-speed transmission connector, a tensile force may be applied in the direction P in which the cable 10 is relatively separated from the shield terminal 17. In this case, when the sleeve 16 moves in the tensile direction P, the rear end edge 16*e* of the sleeve 16 and the front end edge 17*d* of the sheath crimping piece 17*c* of the shield terminal 17 are brought into abutment with each other. This abutment occurs when the cable 10 is pulled, the folding-back portion 13*a* of the braid 13 pushes the rear end of the sleeve 16 in the tensile direction P, and the sleeve 16 is displaced in the tensile direction P. By crimping the braided crimping piece 17*b* to the sleeve 16 via the folded-back braid 13A and crimping the sheath crimping piece 17*c* to the sheath 14, the cable 10 is fixed to the shield terminal 17 to secure a holding force of the cable 10. Therefore, even if a tensile force is applied to the cable 10 by the abutment, the cable 10 can be prevented from being relatively separated (misaligned) from the shield terminal 17. As a result, the electrical connection reliability between the shield terminal 17 and the braid 13 in the cable 10 is prevented from being deteriorated due to misalignment, thereby enhancing the electrical connection reliability. Further, since the misalignment is prevented, the holding force of the cable 10 of the cable assembly 2 is also improved.

In this way, in the cable assembly 2, when a tensile force is applied to the cable 10, the rear end edge 16*e* of the sleeve 16 and the front end edge 17*d* of the sheath crimping piece 17*c* of the shield terminal 17 are brought into abutment with each other, whereby the holding force of the cable 10 is further secured.

As shown in FIG. 8, in the crimped state of the sheath 14 in the sheath crimping piece 17*c*, an inner diameter B of the braid 13 in the crimped portion of the sheath crimping piece 17*c* is the same as an inner diameter A of the braid 13 in the uncrimped portion of the sheath 14. Alternatively, the sheath crimping piece 17*c* is crimped to the outer periphery of the sheath 14 so as to be substantially equivalent. That is, the sheath crimping piece 17*c* is crimped to the outer periphery of the sheath 14 so as to be "inner diameter B of the braid 13=inner diameter A of the braid 13 or inner diameter B of the braid 13≈inner diameter A of the braid 13". Further, as the crimping amount of the sheath crimping piece 17*c* is increased, the inner diameter B of the braid 13 becomes smaller and the holding force becomes higher, but "inner diameter B of the braid 13<inner diameter A of the braid 13", so that the impedance of the cable 10 is mismatched in the axial direction. However, since in the cable assembly 2, the fact is that "inner diameter B of the braid 13=inner diameter A of the braid 13 or inner diameter B of the braid 13≈inner diameter A of the braid 13", it is possible to prevent the impedance from being mismatched while securing the holding force of the cable 10.

Next, a comparative example of the present application will be described. A shielded twisted pair (STP) connector according to a comparative example of the present application is provided with an outer conductor (shield terminal) in an STP dielectric. In the outer conductor, a shield conductor such as a braided wire which surrounds and shields a pair of twisted wires of the STP cable is crimped and crimp-connected at a barrel portion.

However, in the STP connector according to the comparative example, when a tensile force is applied in a direction in which the STP cable is relatively separated from the outer conductor, the shield conductor such as the braided wire may be misaligned from the barrel portion, and in the worst case, the shield conductor may be removed from the barrel portion. Therefore, there is a concern that the electrical connection reliability between the outer conductor and the shield conductor such as the braided wire in the STP cable may be reduced due to misalignment.

Although the present embodiment of the present application has been described above, the present embodiment is not limited thereto, and various modifications can be made within the scope of the gist of the present embodiment.

That is, according to the present embodiment, the sleeve has a C-shaped plate before being crimped and is formed in a cylindrical shape after being crimped, but may have a cylindrical shape before being crimped.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cable assembly comprising a shield terminal including a braided crimping piece and a sheath crimping piece, a cable including a braid and a sheath, and a sleeve attached to an outer periphery of the braid, wherein the cable assembly is formed such that:

the sleeve is disposed on the outer periphery of the braid by crimping, the braid is folded back at a front end side of the sleeve by a folding-back portion, the braid folded back by the folding-back portion covers an outer periphery of the sleeve, the braided crimping piece of the shield terminal is crimped to the outer periphery of the sleeve via the braid folded back by the folding-back portion, and the braid folded back by the folding-back portion is held between the sleeve and the braided crimping piece, a sheath crimping piece of the shield terminal is crimped to an outer periphery of the sheath of the cable, and when a tensile force is applied in a direction in which the cable is relatively separated from the shield terminal, the sleeve is moved in a tensile direction, so that a rear end edge of the sleeve and a front end edge of the sheath crimping piece are brought into abutment with each other.

2. The cable assembly according to claim 1, wherein the sheath crimping piece is crimped to the outer periphery of the sheath such that an inner diameter of the braid in a crimped portion of the sheath crimping piece is the same or substantially the same as an inner diameter of the braid in an uncrimped portion of the sheath.

3. The cable assembly according to claim 1, wherein the sleeve is formed in a C-shaped plate, and the C-shaped sleeve is cylindrically crimped to the outer periphery of the braid.

4. The cable assembly according to claim 1, wherein the sleeve includes an engagement recess at one end side and an engagement protrusion at the other end side, and the engagement protrusion is fitted into the engagement recess when the sleeve is crimped to the outer periphery of the braid.

5. The cable assembly according to claim 1, further comprising an inner housing to which a terminal connected to an exposed internal wire is attached to an end of the cable and a matching member for impedance adjustment having an insertion hole into which the internal wire is inserted, wherein the inner housing and the matching member are integrally housed in a shield connecting portion of the shield terminal.

* * * * *